US005279361A

United States Patent [19]

Cohen

[11] Patent Number: 5,279,361

[45] Date of Patent: Jan. 18, 1994

[54] CROSS FLOW HEAT EXCHANGE DEVICE AND METHOD OF FABRICATING SAID HEAT EXCHANGE DEVICE

[75] Inventor: Barry M. Cohen, Newton Centre, Mass.

[73] Assignee: Gas Research Institute, Chicago, Ill.

[21] Appl. No.: 968,032

[22] Filed: Oct. 26, 1992

[51] Int. Cl.[5] ..... F28D 9/00; F28F 3/00

[52] U.S. Cl. ..... 165/165; 165/164; 29/890.03

[58] Field of Search ..... 165/165, 166, 164; 29/890.03

[56] References Cited

U.S. PATENT DOCUMENTS

| | | | |
|---|---|---|---|
| 2,953,110 | 9/1960 | Etheridge | 165/165 X |
| 3,311,166 | 3/1967 | Southam | 165/166 |
| 4,848,450 | 7/1989 | Lapkowsky | 165/166 |

FOREIGN PATENT DOCUMENTS

| | | | |
|---|---|---|---|
| 1142618 | 1/1963 | Fed. Rep. of Germany | 165/166 |
| 1272343 | 8/1961 | France | 165/165 |
| 0128047 | 11/1978 | Japan | 165/166 |
| 55-65887 | 5/1980 | Japan | 165/165 |
| 215482 | 5/1924 | United Kingdom | 165/165 |
| 538391 | 7/1941 | United Kingdom | 165/165 |

*Primary Examiner*—Allen J. Flanigan
*Attorney, Agent, or Firm*—Lorusso & Loud

[57] ABSTRACT

A heat exchanger with enhanced spacing and sealing characteristics is formed by folding a continuous strip of material having a rectangular pattern stamped thereon. The pattern includes rectangles which constitute base walls and side walls with multiple tabs on the periphery of the strip which comprise wall tabs and bonding tabs respectively. The continuous strip when folded forms a series of alternatingly stacked air passageways, created by the union of each of the base walls, side walls and wall tabs on the periphery of the strip. The bonding tabs may form a seal with a base wall internally, or the bonding tabs may form a seal with another matching bonding tab externally of the created air passageways. The heat exchanger formed upon folding has a number of alternating air passageways which are of a sufficient width for effective transfer of thermal energy.

14 Claims, 8 Drawing Sheets

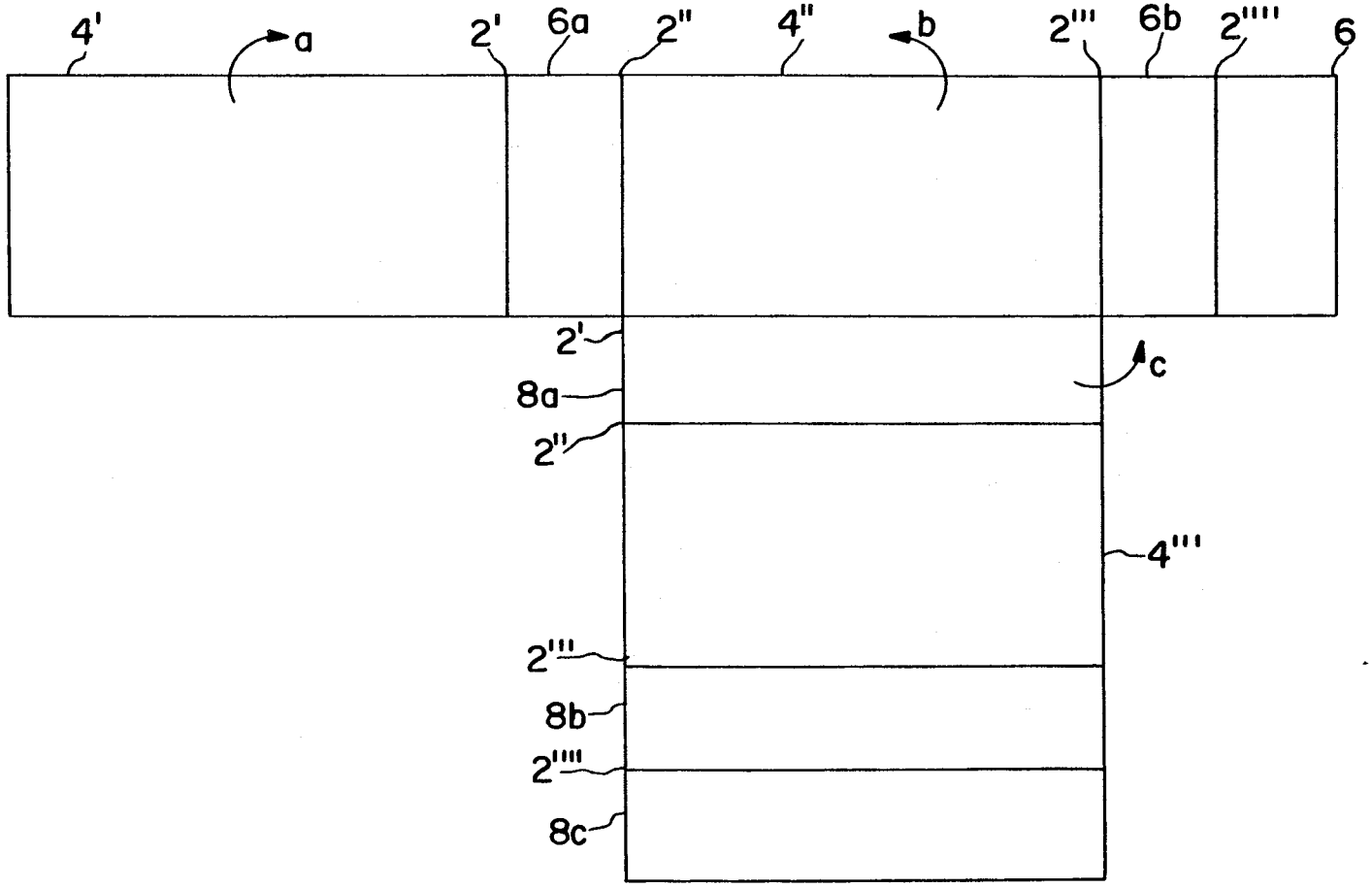
FIG.IB

CROSS FLOW HEAT EXCHANGE DEVICE AND METHOD OF FABRICATING SAID HEAT EXCHANGE DEVICE

BACKGROUND OF THE INVENTION

1. Field of the Invention

The present invention relates to a method of fabricating a heat exchanger, and more particularly to a continuous strip which when folded along a pattern imposed thereon, creates a heat exchanger with alternating flow passages.

2. Description of the Prior Art

Heat exchangers provide a means for transferring thermal energy from one fluid stream to another while permitting no mixing of streams to occur. Heat exchangers are often used in indirect evaporative coolers whereby a water spray evaporatively cools scavenger air in the passages thereof.

Early heat exchangers were fabricated by joining separate plates in an adjacent manner so as to provide passageways for air flow. However, the large number of edges needed to be bonded, combined with the ineffectiveness of such bonds, led to problems such as cross leakage and inefficient transfer of energy. Such problems prompted the bonding of the edges of many separate plates to be replaced by the folding of a continuous strip of material.

The continuous strip of material forming most conventional heat exchangers, is usually patterned with fold lines thereon and folded along such lines to arrive at a configuration appropriate for thorough heat exchange. By folding as many edges of the strip as possible, the number of edges that must be bonded is greatly reduced.

Although this process has led to a reduction in the number of edges which require bonding, the pattern on the strip and the manner in which the edges have been bonded has led to limitations on the spacing between walls of the heat exchanger. The spacing of the walls determines the effectiveness of air flow. Spacing is lessened when the parallel walls forming the flow passageways are directly adhered to one another.

An example of such a system is shown in German Publication No. 25 21 351 whereby a heat exchanger is fabricated from a foil-like material folded 180° several times in a zig-zag fashion. An alternating system is achieved, in that the flow through channels are open alternately in directions that are 90° to one another. However, the spacing between the exchanger walls is significantly narrow. This is due to the attachment of the edges of the walls directly to one another. By joining the walls in such a fashion, crossflow is severely inhibited as the air flow passage created by the walls is of an extremely small width.

Ineffective spacing leading to improper crossflow is also a problem with the heat exchanger of U.S. Pat. No. 4,343,355 to Goloff et al. In this system, the unitary material has sections which are fastened through the use of tabs. However, these tabs are welded so as to form a circular wall joining the sections which form the parallel walls of the fluid passages. There are many problems inherent in such a construction. Since a wall of the passageway is formed by a joinder of tabs there is a high probability of air leakage in in the area of the tabs during use. Additionally, in this system an alternating type heat exchanger is not achieved, as air flow is unidirectional.

Another system in which air flow is restricted is in U.S. Pat. No. 4,384,611 to Fung, whereby the end edges of a unitary material are pinched closed along their length to form a wall. Having the walls of the exchanger being formed by such a pinched seam decreases the effectiveness of air flow through the exchanger, as the distance between the parallel walls due to the pinched seam is small. Additionally, the strength and durability of such a pinched seam is speculative, given the tendency of the walls being pinched together to exert forces opposing such an attachment. Also in this system, an alternating pattern of air flow is not achieved.

Another heat exchanger also possessing inadequate spacing between air flow passages is set forth in Japanese Publication No. 53-128047. A unitary strip of material is folded so as to achieve an alternating type heat exchanger. In this exchanger, a tab forms a wall of the exchanger by attachment to the edge of another wall. Although the attachment provides a certain amount of spacing for airflow, a part of the tab itself must be sealed to a parallel wall. Thus, there is a tendency that a portion of the width of the tab will be provided for attachment to a wall, leading to decreased spacing between the parallel walls of the passageway. Additionally, the possibility of air leakage is great with such a construction.

OBJECTS OF THE INVENTION

It is an object of the invention to provide a heat exchanger whereby the number of bonded edges is reduced and the spacing between the walls of the exchanger is enhanced.

It is an additional object of the invention to provide a heat exchanger having enhanced bonding characteristics thereby reducing the possibility of cross leakage.

It is a further object of the invention to facilitate construction of a heat exchanger by making bonding of tabs easily accessible.

According to the present invention, the foregoing and other objects are attained by providing a continuous strip of material for fabricating a heat exchanger wherein the body of the strip has a rectangular pattern of side walls and base walls and has multiple tabs on the periphery thereof such that the tabs comprise wall tabs and bonding tabs respectively. Each wall tab is folded and joined with a folded side wall and base wall, thereby creating an air flow passageway. Bonding is carried out through bonding tabs emanating from the side wall tabs, which are bonded to an inner face of the base walls, respectively.

In accordance with another aspect of the invention, that of facilitating ease of construction and reparative maintenance, is to provide a continuous strip of material for fabrication of a heat exchanger having a rectangular pattern thereon whereby two sets of tabs are formed on the periphery of the strip. The first set comprises a wall tab and a bonding tab and the second set comprises a matching bonding tab, so that the wall tab may be folded to form a side wall of a passageway and the bonding tabs may be joined to form a bond external to the passageway.

In accordance with yet another aspect of the invention, that of facilitating enhanced construction is to provide a continuous strip of material for fabrication of a heat exchanger having a rectangular pattern thereon whereby two sets of tabs are formed on the periphery of the strip. The first set comprises a wall tab and a bonding tab and the second set comprises a matching bonding tab, so that the wall tab may be folded to form a side wall of a passageway and the bonding tabs may be joined to form a bond on the external surface of a wall of the passageway.

Still other objects and advantages of the present invention will become readily apparent to those skilled in the art from the following detailed description, wherein I have shown and described the preferred embodiment of the invention, simply by way of illustration for the best mode contemplated by me for carrying out my invention. Accordingly, the drawings and description are to be regarded as illustrative in nature, and not as restrictive.

BRIEF DESCRIPTION OF THE DRAWINGS

FIG. 1*b* is an expanded portion of the continuous strip of FIG. 1*a*.

DETAILED DESCRIPTION OF THE PREFERRED EMBODIMENTS

Figure 1A:
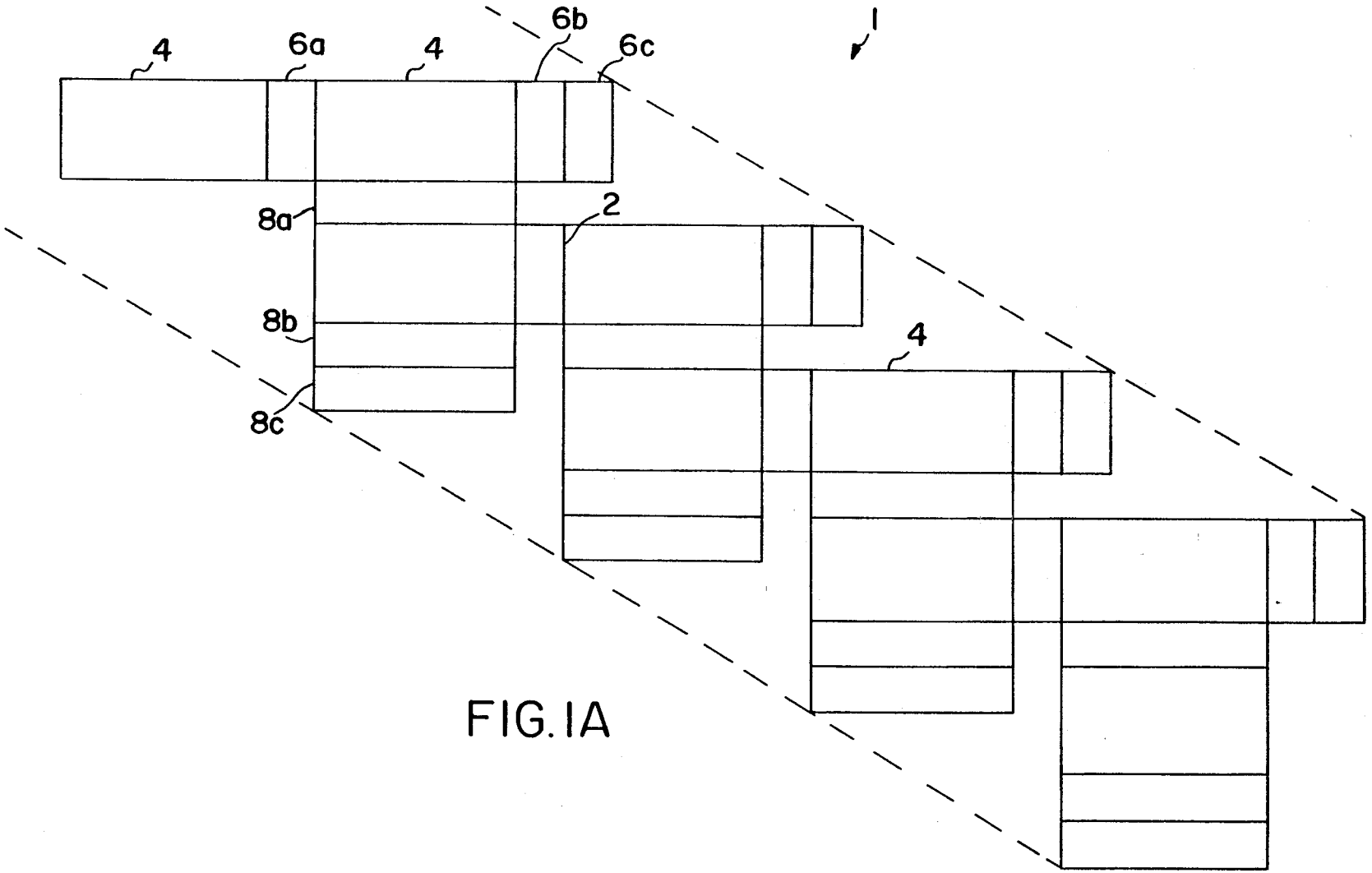
FIG. 1*a* is a plan view of the continuous strip employed to form the heat exchanger of the first embodiment.

FIG. 1*a* shows the continuous strip 1 which is folded to form the heat exchanger of the preferred embodiment. The material employed may encompass any material that is pliable, such as metal sheets or thermoformed plastic sheets, however the scope of materials to be used is not limited thereto.

As seen in this figure, there is a repeating rectangular pattern formed on the continuous strip 1 which creates air flow passageways when the individual rectangles are folded at 90° angles along pattern lines 2. The rectangular pattern consists of three differently sized rectangles. One size shown in the pattern is a large rectangle, which when folded forms a base wall 4. The other rectangles shown include a small rectangle and a long rectangle, which when folded form a short side wall 6*a* and a long side wall 8*a* of the air passages, respectively.

The strip has side wall tabs 6*b* and 8*b* which are of the identical size as short side wall 6*a* and long side wall 8*a*. These tabs are formed on the periphery of the strip 1 and are adapted to form walls of the air flow passageways. From these tabs 6*b* and 8*b*, emanate bonding tabs 6*c* and 8*c* respectively, which are adapted to seal the rectangular air flow passageway.

As the continuous strip 1 is folded along fold lines 2, rectangular air passageways are formed from the union of two base walls 4 with a short side wall 6*a* and a short side wall tab 6*b*, and from the union of two base walls 4 with a long side wall 8*a* and a long side wall tab 8*b* respectively. The short side wall 6*a* and short side wall tab 6*b*, along with long side wall 8*a* and long side wall tab 8*b*, alternately emerge as the strip 1 is folded.

Figure 1*b* shows an expanded portion of the rectangular pattern on the continuous strip 1 to illustrate the manner in which the strip is folded to form the rectangular air passageways. Pattern lines 2' and 2'' are shown to indicate the boundaries defining the boundaries of each of the side walls 6*a* and 8*a*. Pattern line 2''' are shown to define the boundaries of each of the side walls tabs 6*b* and 8*b*, from the base walls. Pattern line 2'''' is shown to define the boundaries of each of the bonding tabs 6*c* and 8*c* from the side wall tabs 6*b* and 8*b* respectively.

Folding is easily accomplished by folding base wall 4' at a 90° angle along fold line 2' in the direction of the arrow a. Next, base wall 4'' is folded along pattern line 2'' at a 90° angle in the direction of the arrow b. At this point, the folded configuration resembles a U-shape, with short side wall 6*a* resembling the bottom of the U-shape and base walls 4' and 4'' resembling the sides of the U-shape. Extending from base wall 4'' remains short side wall tab 6*b* and short bonding tab 6*c*. Short side wall tab 6*b* is then folded at a 90° angle along fold line 2''' so as to close the top of the U-shape by meeting the edge of base wall 4', thereby creating a rectangle. Short bonding tab 6*c* is then folded inwardly toward the base wall 4', at a 90° angle along fold line 2'''' so as to lie in a plane parallel and adjacent to base wall 4'. Short bonding tab 6*c* is then bonded to the inner face of base wall 4'. Thus an air passageway 10, as shown in FIG. 1*c*, is created and sealed.

In creating an adjacent alternating air passageway, long side wall 8*a* is then folded at a 90° angle along pattern line 2' in the direction of arrow c. Base wall 4'' will function as a wall in both of the air passageways 10, 12 created. Base wall 4''' is then folded in the same direction as arrow c, in a 90° angle along fold line 2'', thereby creating a U-shape. Likewise long wall tab 8*b* is folded at a 90° angle along fold line 2''', following the direction of arrow c so as to close the top of the U-shape by meeting the edge of base wall 4'', thereby creating a rectangle. Long bonding tab 8*c* is folded inwardly toward the base wall 4'' at a 90° angle along fold line 2'''' so as to lie in a plane parallel and adjacent to base wall 4''. Long bonding tab 8*c* is then bonded to the inner face of base wall 4''. Bonding of both the short and long bonding tabs, 6*c* and 8*c* respectively, may be carried out through welding, through the use of adhesives, or in any number of suitable means known in the art. Thus a second air passageway 12, as shown in FIG. 1*c* is created.

Figure 1C:
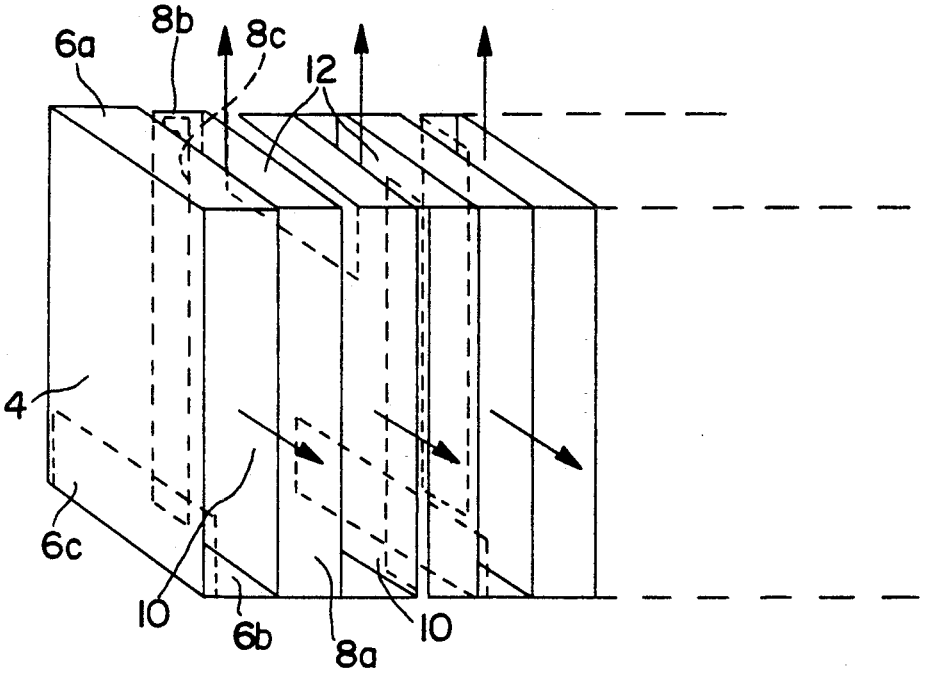
FIG. 1*c* is a perspective view of the continuous strip of FIG. 1*a* folded to form the heat exchanger of the first embodiment.

Shown in FIG. 1*c*, are the stacked air passageways formed by continuously folding the strip 1, as outlined in the above discussion of FIG. 1*b*. The two types of air passageways created as the strip 1 is folded are passageways accommodating horizontal air flow 10 and passageways accommodating vertical air flow 12.

This construction possesses distinct advantages over the prior art. The first advantage is that the spacing between base walls 4 is increased due to the width of an entire wall tab, either 6*b* or 8*b* respectively, lying therebetween. Additionally, air leakage is minimized due to the bonding of the bonding tabs 6*c*, 8*c* to the inner faces of base walls 4. Furthermore, such an inner seal is effectively free of outer disturbance when the heat exchanger is used in combination with other elements.

Figure 2A:
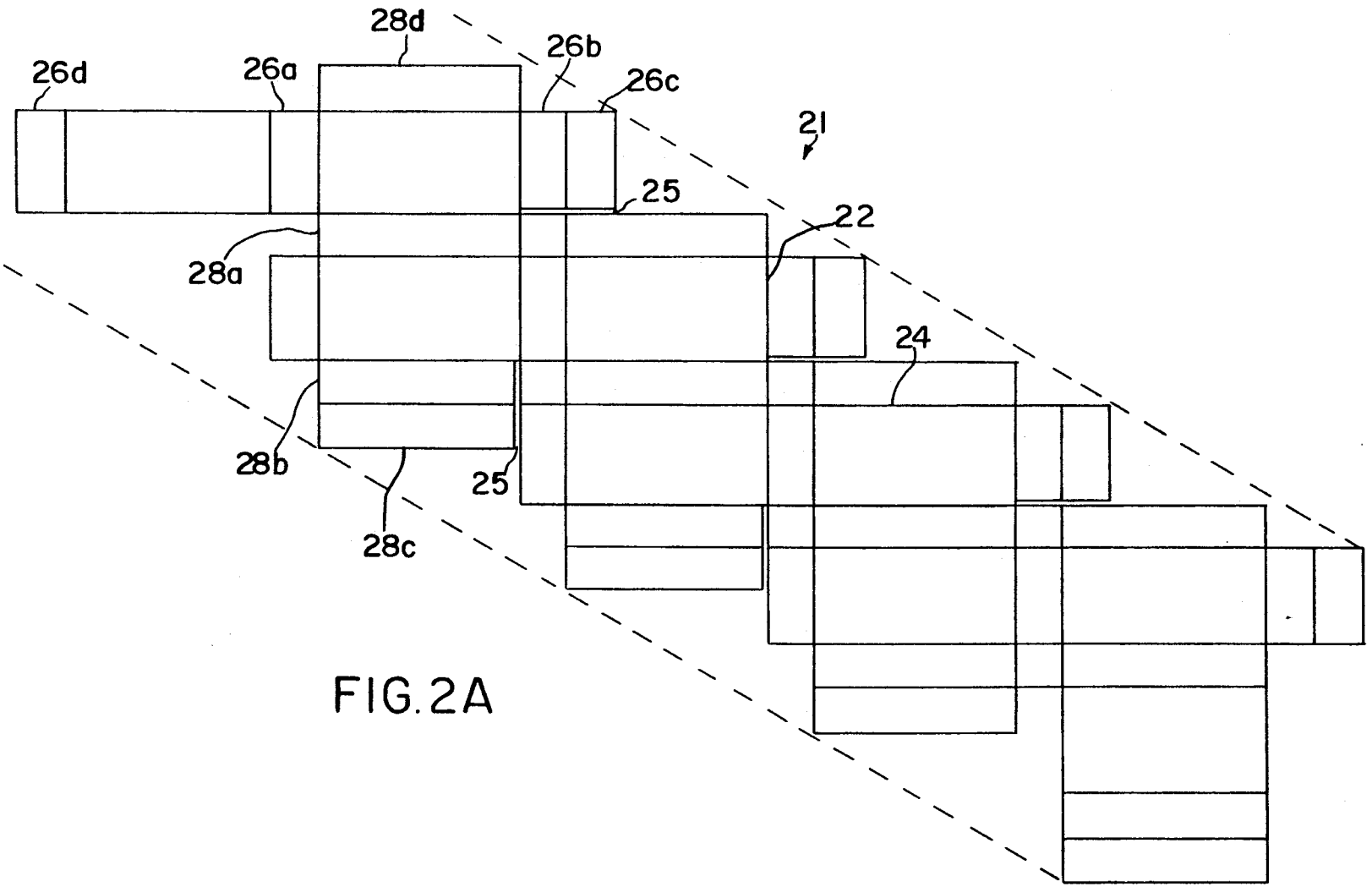
FIG. 2*a* is a plan view of the continuous strip employed to form the heat exchanger of the second and third embodiments.

FIG. 2*a* shows a continuous strip 21 which is folded to form the heat exchanger of the second and third embodiments. This figure is similar to FIG. 1*a* in that there is a repeating rectangular pattern stamped onto the continuous strip 21, which when folded at 90° angles along the fold lines 22, form air flow passageways. Cuts 25 are made in the continuous strip 21, so as to sever short side wall tabs **26*b* and short bonding tabs 26*c*, from long matching bonding tabs 28*d*. Additionally, cuts 25 are made in the continuous strip 21, so as to sever long side wall tabs 28*b* and long bonding tabs 28*c*, from short matching bond tabs 26*d*. Cuts 25, facilitate folding of the continuous strip 21** in forming the alternating air passageways.

The air passageways are formed from the union of two base walls 24 with a short side wall **26*a* and a short side wall tab 26*b*, or the union of two base walls 24 with a long side wall 28*a* and a long side wall tab 28*b* respectively. The short side wall 26*a* with the short side wall tab 26*b* and the long side wall 28*a* with the long side wall tab 28*b*, alternately emerge and join with the base walls 24** to form an air passageway as the strip is continuously folded.

The periphery of the strip 21 has bonding tabs **26*c*, 28*c* and matching bonding tabs 26*d*, 28*d*** which are adapted to close the rectangular air passageways. As shown in FIG. 2*a* short wall **26*a*, short wall tab 26*b*, short bonding tab 26*c* and short matching bonding tab 26*d* are all folded at 90° angles with respect to each other. Short wall 26*a* and short wall tab 26*b* form a first alternating air passageway when joined with two base walls 24. Short bonding tab 26*c* and short matching bonding tab 26*d* form the seal for the air passageway. Likewise long wall 28*a*, long wall tab 28*b*, long bonding tab 28*c*, and long matching bonding tab 28*d* are all folded at 90° angles with respect to each other. Long wall 28*a* and long wall tab 28*b* form a first alternating air passageway when joined with two base walls 24. Long bonding tab 28*c* and long matching bonding tab 28*d*** form the seal for the air passageway.

Figure 2B:
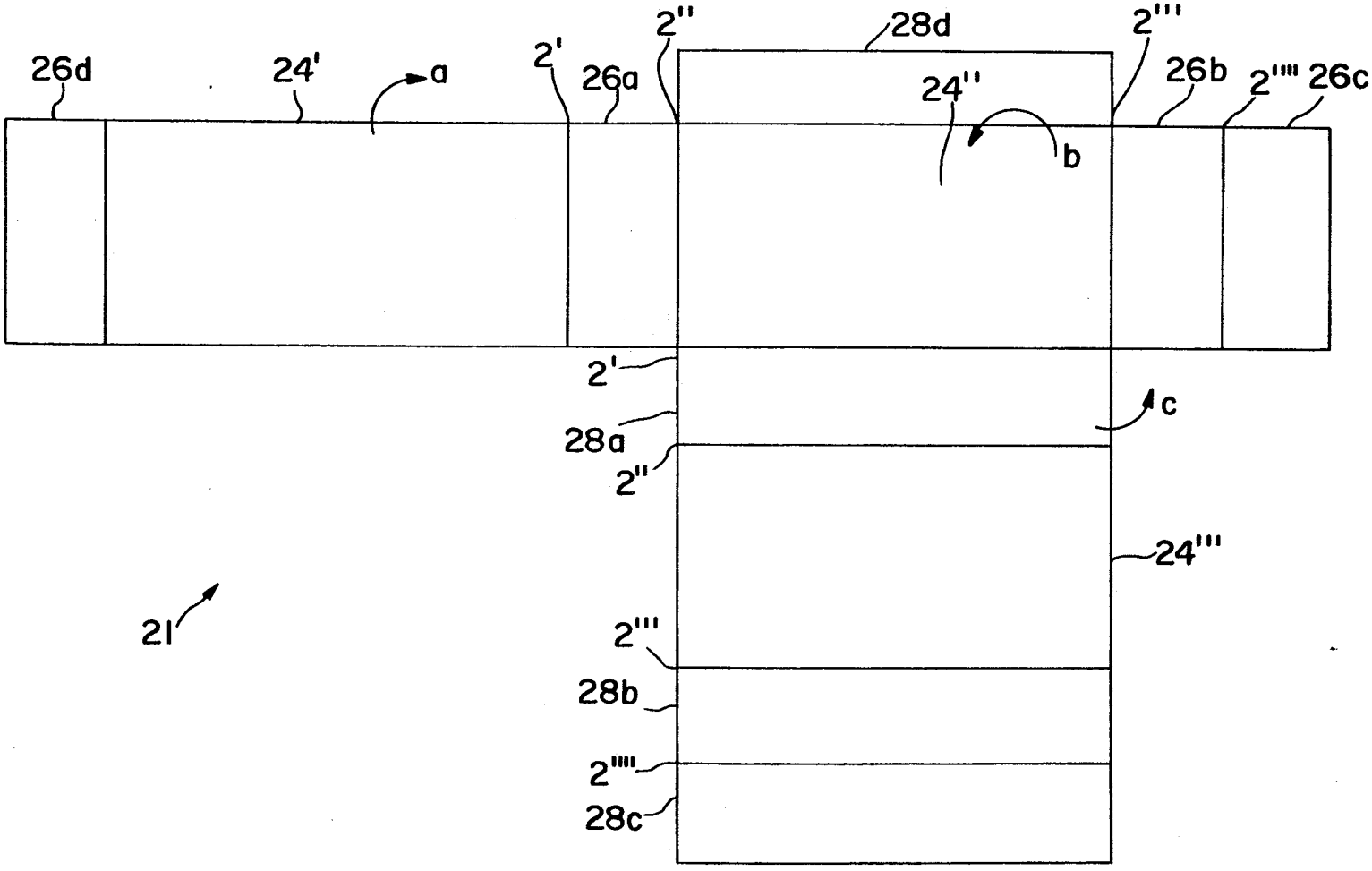
FIG. 2*b* is an expanded portion of the continuous strip of FIG. 2*a*.

FIG. 2*b* shows an expanded portion of the rectangular pattern on the continuous strip 21 to illustrate the manner in which the strip 21 is folded to form the rectangular air passageways of the second and third embodiments. The method of folding is similar to that described in reference to FIG. 1*b*, with a few exceptions which will be described herein.

To form the second embodiment as realized in FIG. 2*b*, folding is carried out as described in FIG. 1*b*, so as to form the walls of the passageway, except short bonding tab **26*c*, instead of being folded along fold line 2'''' inwardly, toward one of the base walls of the passageway for internal bonding, is folded outwardly at a 90° angle along fold line 2'''' so as to form a lengthwise extension of base wall 24'. Base wall 24' has matching short bonding tab 26*d* emanating therefrom. When the short bonding tab 26*c* is folded outwardly from short side wall tab 26*b* in such a manner, it lies adjacent to the matching short bonding tab 26*d*. The two tabs 26*c*, 26*d* are then bonded together to form an external seal. Thus an air passageway 30**, as shown in FIG. 2*c* is created and sealed.

The bonding of long bonding tab **28*c* and matching long bonding tab 28*d* is carried out in the same manner. Instead of folding long bonding tab 28*c* along fold line 2'''' inwardly toward one of the base walls of the passageway for internal bonding, so as to lie adjacent to base wall 24'', it is folded outwardly at a 90° angle so as to form a widthwise extension of base wall 24''. Base wall 24'' has a matching long bonding tab 28*d* emanating therefrom. When the long bonding tab 28*c* is folded in such a manner it lies adjacent to the matching long bonding tab 28*d*. The two tabs 28*c*, 28*d* are then bonded together to form an external seal. Again bonding of both the short and long bonding tabs may be carried out through welding, or the use of adhesives or in any number of suitable means known in the art. Thus an air passageway 32**, as shown in FIG. 2*c* is created and sealed.

Figure 2C:
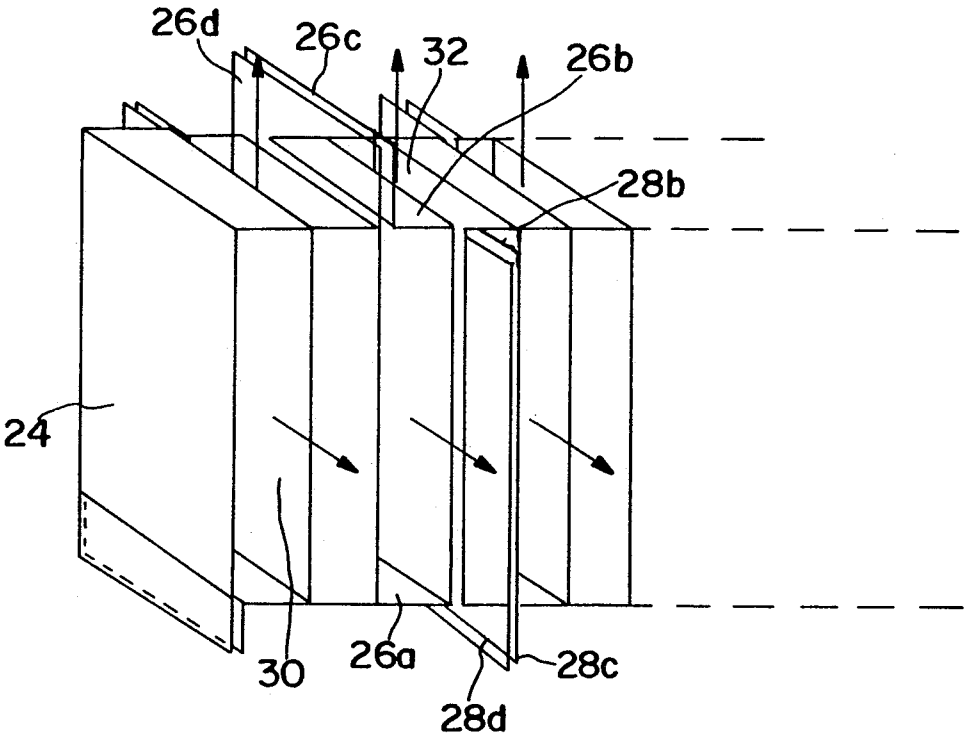
FIG. 2*c* is a perspective view of the continuous strip of FIG. 2*a* folded to form the heat exchanger of the second embodiment.

These alternating air passageways are seen in FIG. 2*c*. As shown in this figure, the strip forms a series of stacked rectangularly alternating air passageways accomplished by continual folding. The first type of passageway 30 is shown as permitting air flow to occur horizontally and the second type of passageway 32 is shown as permitting air flow to occur vertically.

The advantage of the construction of the second embodiment is that the bonding of edges is easily accomplished due to the fact that all bonding of edges takes place external to the passageway. Should reparative welding be needed, the tabs **26*c*, 26*d* and 28*c*, 28*d* are easily accessible when located externally of the air flow passageway. An additional advantage is that the spacing is again guaranteed to equal the entire width of the short wall tab 26*b* and long wall tab 28*b***, which will aid in producing effective crossflow.

Figure 2D:
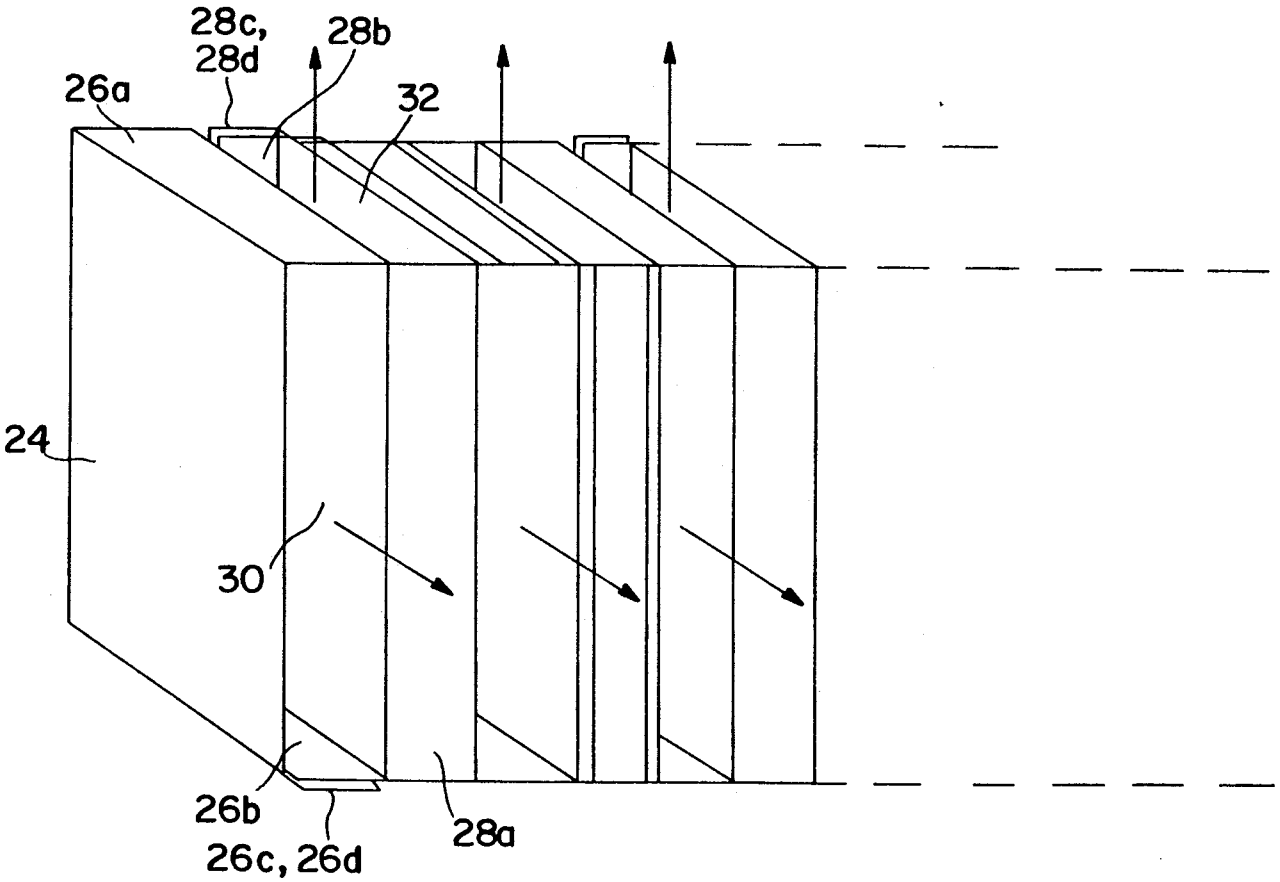
FIG. 2*d* is a perspective view of the continuous strip of FIG. 2*a* folded to form the heat exchanger of the third embodiment.

To form the third embodiment of FIG 2*d*, the bonding of edges is the same as that outlined in FIG. 2*b* above, however the matching bonding tabs **26*d*, 28*d* after being bonded to bonding tabs 26*c*, 28*c* respectively, are folded at a 90° angle along pattern line 2''''. The matching bonding tab 26*d* after being bonded to bonding tab 26*c*, and the matching bonding tab 28*d* after being bonded to bonding tab 28*c*, respectively, after being folded, are then bonded to the outer surface of side wall tabs 26*b* and 28*b***, respectively.

There are many advantages associated with the construction of the third embodiment. The bonded edges lie external to the air passageway, as the external faces of the side walls **26*b*, 28*b*** only, have the matching bonding tabs and bonding tabs affixed thereto. Additionally, this embodiment achieves a more compact design. Moreover, there is no internal bonding of edges and reparative maintenance is easily afforded as a result. Furthermore this embodiment is easily adapted to other elements in an indirect evaporative cooler when employed for such purposes.

Figure 3:
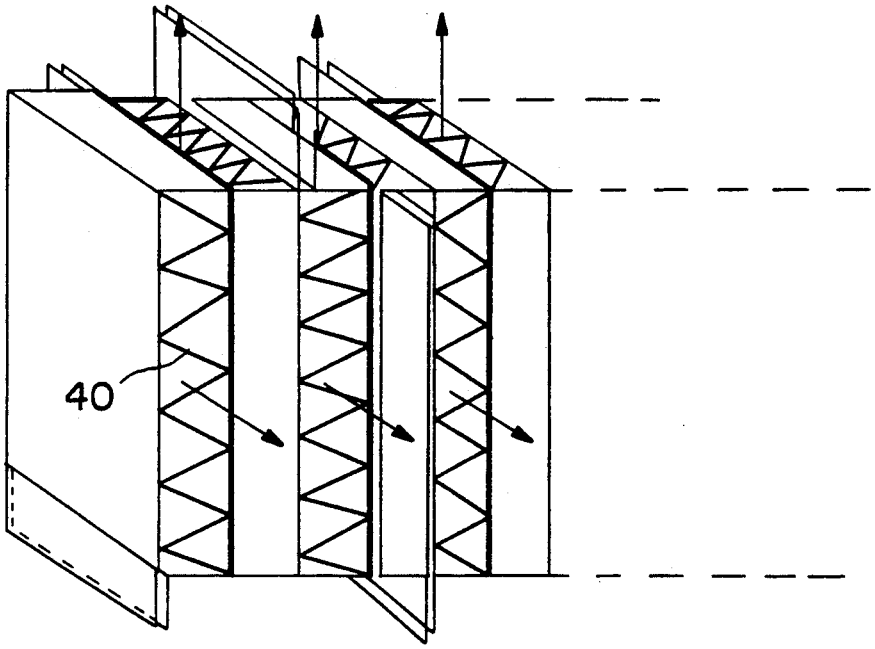
FIG. 3 is a perspective view of spacer plates disposed within alternating passageways of the heat exchanger.

As shown in FIG. 3 the heat exchanger may have spacer plates 40 disposed between the base walls 24. The heat exchanger of the first embodiment and third embodiment may have spacer plates disposed between the base walls 4 as well. Such spacer plates 40 may be wavy or corrugated so as to maintain the distance between the base walls. These plates may be formed through folding or may be separately bonded through any suitable means.

The embodiments illustrated and described above for heat exchangers and methods of making same, are merely representative of broader concepts which are the subjects of this application and are presented in the claims. Accordingly, various modifications of these disclosures are possible within the spirit and intent of this invention and appended claims.

What I claim is:

1. A method of making a heat exchanger comprising:

a) forming a continuous strip of material having pattern lines defining base walls and side walls, each of said walls having an internal face and an external face, said pattern lines further defining tabs on the periphery of said strip, said tabs comprising side wall tabs and bonding tabs, whereby each of said bonding tabs emanates and is distinguished from said each of said side wall tabs by said pattern lines, b) folding said strip at an angle along each of said pattern lines so that each of said base walls and each of said side walls join with each of said side wall tabs thereby forming stacked alternating air passageways accommodating horizontal and vertical airflow, respectively.

2. The method of making a heat exchanger of claim 1, further comprising:

c) sealing said air passageways by folding said bonding tabs at a 90° angle inwardly toward each of said air passageways and attaching each of said bonding tabs to an internal face of a base wall.

3. The method of making a heat exchanger of claim 2, further comprising:

d) disposing a spacer plate in each of said alternating air passageways.

4. The method of making a heat exchanger of claim 1, wherein said step of folding further comprises folding said strip at a 90° angle.

5. A method of making a heat exchanger comprising:

a) forming a continuous strip of material having pattern lines defining base walls and side walls, each of said walls having an internal face and an external face, said pattern lines further defining tabs on the periphery of said strip, said tabs comprising side wall tabs and bonding tabs, whereby each of said bonding tabs emanates and is distinguished from each of said side wall tabs by said pattern lines, said tabs further comprising matching bonding tabs adapted to be joined and bonded to said bonding tabs, b) folding said strip at a 90° angle along each of said pattern lines so that each of said base walls and each of said side walls join with each of said wall tabs to form stacked alternating air passageways accommodating horizontal and vertical airflow, respectively.

6. The method of making a heat exchanger of claim 5, further comprising:

c) sealing each of said air passageways by folding each of said bonding tabs at a 90° angle to each of said wall tabs, respectively, thereby causing each of said bonding tabs to lie adjacent and parallel to each of said matching bonding tabs, and bonding said bonding tabs and said matching bonding tabs.

7. The method of making a heat exchanger of claim 6, further comprising:

d) disposing a spacer plate in each of said alternating air passageways.

8. A heat exchanger comprising:

a continuous strip of material folded to form a stack of air passageways, each of said air passageways comprising base walls and side walls, each of said base walls having a side wall tab emanating therefrom, each of said side wall tabs having a bonding tab emanating therefrom, whereby each of said bonding tabs form a bond with one of said base walls, such that said side walls are free of bonding, and said air passageways are disposed so as to permit vertical and horizontal air flow, respectively.

9. A heat exchanger comprising:

a continuous strip of material having a rectangular pattern adapted to form a stack of rectangularly alternating air passageways when folded, said rectangular pattern comprising pattern lines defining rectangular base walls, rectangular side walls and rectangular tabs, said rectangular tabs lying on the periphery of said strip, whereby said rectangular tabs comprise side wall tabs with bonding tabs emanating and defined from each of said side wall tabs by said pattern lines, wherein each of said side wall tabs is folded at a 90° angle to each of said base walls so as to form each of said side walls of said passageways, and said bonding tab is folded at a 90° angle to said side wall tab, so as to bond to each of said base walls.

10. The heat exchanger of claim 9 wherein each of said side walls of said air passageway is free of bonding.

11. A heat exchanger comprising:

a continuous strip of material having pattern lines thereon, said continuous strip forming a stack of alternating air passageways when folded along said pattern lines, said pattern lines defining base walls, said walls and tabs, said tabs lying on the periphery of said strip, whereby said tabs comprise side wall tabs with a bonding tab emanating and defined from each of said side wall tabs by said pattern lines, said tabs further comprising matching bonding tabs, whereby each of said side wall tabs is folded at an angle to each of said base walls so as to form a side wall of each of said passageways, each of said bonding tabs is folded at an angle to each of said side wall tabs, whereby each of said bonding tabs and each of said matching bonding tabs are joined externally of the walls of said passageway.

12. The heat exchanger of claim 11, wherein each of said walls of said air passageways is free of bonding.

13. A heat exchanger comprising:

a continuous strip of material having pattern lines thereon, said continuous strip forming a stack of alternating air passageways when folded along said pattern lines, said pattern lines defining base walls, said walls and tabs, said tabs lying on the periphery of said strip, whereby said tabs comprise side wall tabs with a bonding tab emanating and defined from each of said side wall tabs by said pattern lines, said tabs further comprising matching bonding tabs, whereby each of said side wall tabs is folded at an angle to each of said base walls so as to form a side wall of each of said passageways, each of said bonding tabs is folded at an angle to each of said side wall tabs, whereby each of said bonding tabs and each of said matching bonding tabs are folded together at an angle so as to form a bond with each of said side wall tabs.

14. A heat exchanger comprising:

a continuous strip of material having pattern lines defining base walls and side walls, each of said side walls further having a sidewall tab emanating therefrom, each sidewall tab having a bonding tab emanating therefrom, wherein said base walls and said side walls form a series of alternatingly stacked air passageways, and each bonding tab is bonded to one of said walls thereby sealing each of said passageways.

* * * * *

UNITED STATES PATENT AND TRADEMARK OFFICE

CERTIFICATE OF CORRECTION

PATENT NO. : 5,279,361

DATED : January 18, 1994

INVENTOR(S) : Barry M. Cohen

It is certified that error appears in the above—identified patent and that said Letters Patent is hereby corrected as shown below:

In Column 8 in Line 26, delete "said" and insert therefore --side--.

In Column 8 in Line 45, delete "said" and insert therefore --side--.

Signed and Sealed this

Twenty-fourth Day of May, 1994

Bruce Lehman

*Attest:*

BRUCE LEHMAN

*Attesting Officer*

*Commissioner of Patents and Trademarks*